US005374070A

United States Patent [19]

Pellegrini, Jr. et al.

[11] Patent Number: 5,374,070

[45] Date of Patent: Dec. 20, 1994

[54] BRAKING DEVICE PARTICULARLY FOR SKATES

[75] Inventors: Alfred Pellegrini, Jr., Montebelluna; Andrea Tormena, Crocetta del Montello; Alessandro Pozzobon, Paderno di Ponzano Veneto; Renzo Balbinot, Pieve di Soligo; Mario Conella, Conegliano, all of Italy

[73] Assignee: Nordica S.p.A., Trevignano, Italy

[21] Appl. No.: 51,404

[22] Filed: Apr. 23, 1993

[30] Foreign Application Priority Data

| | | | |
|---|---|---|---|
| Apr. 29, 1992 | [IT] | Italy | TV92U000026 |
| Sep. 1, 1992 | [IT] | Italy | TV92A000098 |
| Mar. 5, 1993 | [IT] | Italy | TV93A000021 |

[51] Int. Cl.[5] ..... A63C 17/14

[52] U.S. Cl. ..... 280/11.2; 280/11.22

[58] Field of Search ..... 280/11.19, 11.2, 11.22, 280/11.23; 188/5, 6, 7

[56] References Cited

U.S. PATENT DOCUMENTS

| | | | |
|---|---|---|---|
| 920,848 | 5/1909 | Eubank, Jr. | 280/11.2 |
| 1,497,224 | 6/1924 | Ormiston | 280/11.2 |
| 4,054,296 | 10/1977 | Sullins | 280/11.2 |
| 4,275,895 | 6/1981 | Edwards | 280/11.2 |
| 4,807,893 | 2/1989 | Huang | 280/11.2 |
| 5,069,462 | 12/1991 | Murga | 280/11.2 |
| 5,088,748 | 2/1992 | Koselka et al. | 280/11.2 |
| 5,183,275 | 2/1993 | Hoskin | 280/11.2 |

FOREIGN PATENT DOCUMENTS

| | | |
|---|---|---|
| 0379906 | 8/1990 | European Pat. Off. . |
| 230621 | 6/1910 | Germany . |
| 438462 | 12/1926 | Germany . |
| 2537778 | 3/1977 | Germany . |

*Primary Examiner*—Richard M. Camby

*Attorney, Agent, or Firm*—Guido Modiano; Albert Josif; Daniel O'Byrne

[57] ABSTRACT

A braking device for skates includes a rod member associated with the quarter of the shoe; the lower end of the rod member has a braking member adapted to interact with a wheel on the ground when the quarter is tilted back.

11 Claims, 7 Drawing Sheets

BRAKING DEVICE PARTICULARLY FOR SKATES

BACKGROUND OF THE INVENTION

The present invention relates to a braking device particularly usable for skates which comprise an item of footgear including a quarter articulated to a shell which is in turn associated with a supporting frame for two or more wheels.

Currently, in known roller skates, whether constituted by a shoe associated with a support for two pairs of mutually parallel wheels or constituted by a shoe associated with a supporting frame for two or more aligned wheels, the problem of braking said wheels to adjust the speed of the skate is significantly felt.

It is known to use adapted blocks or pads usually made of rubber and arranged at the toe or heel region of the shoe; when the user tilts the shoe forwards or backwards, the free end of the blocks or pads interacts with the ground and the braking action is thus obtained.

These conventional brakes have the considerable drawback that they require the user to rotate the shoe, and accordingly the frame associated therewith, at the toe or heel, and this can cause loss of balance with consequent falls.

U.S. Pat. No. 1,402,010 discloses a roller skate provided with a band to be fastened on the leg of the user above the malleolar region and to which a rod is connected.

The rod embraces the leg in a rear region and is associated, at its ends, in the malleolar region, with a lever system articulated to a structure protruding from the wheel supporting frame.

Said lever system protrudes to the rear of the frame and is connected to a plate shaped approximately complementarily to the curve of part of an underlying facing wheel.

This solution also has drawbacks; first of all, relative movement occurs between the band and the leg throughout sports practice, and this does not make its use comfortable due to the continuous rubbing of the band on the leg.

Furthermore, the plate is activated every time the user bends his leg backwards beyond a given angle, without real and easy possibilities of changing this condition.

Because each individual has a different leg shape, braking occurs at different rotation angles for an equal length of the rod.

The rod also rests and presses on the malleolar region, and this can cause discomfort or accidental impacts.

U.S. Pat. No. 4,275,895 is known as a partial solution to this problem and describes a brake for skates having two pairs of mutually parallel wheels; the brake acts at the rear wheels.

The brake is constituted by a flap associated with the item of footgear in a rearward position. A blade is associated with the flap in a rearward position and is pivoted at the supporting frame of the item of footgear.

The blade has, at its free end, a transverse element on which a pair of C-shaped elements is formed at the lateral ends. The C-shaped elements interact, upon a backward rotation imparted to the flap, with the rear wheels facing them, namely, the C-shaped elements interact with their rolling surface.

However, this solution too has drawbacks; it is in fact structurally complicated and therefore difficult to industrialize. It also requires an adapted spring suitable to allow the flap to return to the condition in which the pair of C-shaped elements does not interact with the wheels, and this further increases structural complexity.

U.S. Pat. No. 4,300,781 discloses a braking device for skates comprising pairs of mutually parallel wheels.

The brake comprises a blade pivoted transversely at the rear end of the frame for supporting a shoe. Pads are associated with its ends and face the rolling surface of the pair of rear wheels.

The brake is activated by using a cable suitable to rotate the blade in contrast with a spring associated with the support for the pair of front wheels, so as to move the pads into contact with the rolling surface of the pair of rear wheels.

The cable can be activated by means of rings or handles which are associated with a band which is arrangeable on the lower limbs of the user through connection members.

However, this solution has considerable drawbacks; first of all, activation of the brake can lead to possible losses of balance during sports practice, since the user does not assume, with his body, a position suitable to control the sudden speed reduction; only the hand of the skater is in fact involved in the activation of the brake.

Furthermore, since the sport can be practiced while wearing trousers, when pulling the rings the band might slide along the trousers or might make the trousers slide along the leg, making the braking action ineffective.

There is also a loose cable which is a hindrance to the skater and can accidentally catch during skating, especially in view of the fact that coordination of arm-leg movement rhythmically arranges the legs laterally toward the outside.

SUMMARY OF THE INVENTION

The aim of the present invention is therefore to eliminate the drawbacks described above in known types by providing a braking device for skates which is structurally very simple and easy to industrialize and activate.

Within the scope of the above aim, an important object is to provide a braking device which can be activated by the user in case of actual need and never accidentally.

Another important object is to provide a braking device which can be activated and deactivated rapidly and in a simple manner by the user.

Another important object is to provide a braking device wherein activation of the braking action can be preset by the user according to his individual requirements.

Another important object is to provide a braking device which does not hinder the user during ordinary sports practice.

Another object is to provide a device which is furthermore reliable and safe in use, has modest manufacturing costs and can also be applied to known skates.

This aim, these objects and others which will become apparent hereinafter are achieved by a braking device, particularly for skates which comprise an item of footgear composed of a quarter articulated to a shell associated with a supporting frame having a set of wheels adapted to roll on the ground, characterized in that it comprises at least one rod member associated with said quarter, at least one braking element being associated with said at least one rod member, said braking element being adapted to interact with either one of said wheels and said ground upon a rotation of said quarter.

BRIEF DESCRIPTION OF THE DRAWINGS

Further characteristics and advantages of the invention will become apparent from the detailed description of a particular embodiment, illustrated only by way of nonlimitative example in the accompanying drawings, wherein.

DESCRIPTION OF THE PREFERRED EMBODIMENTS

Figure 1:
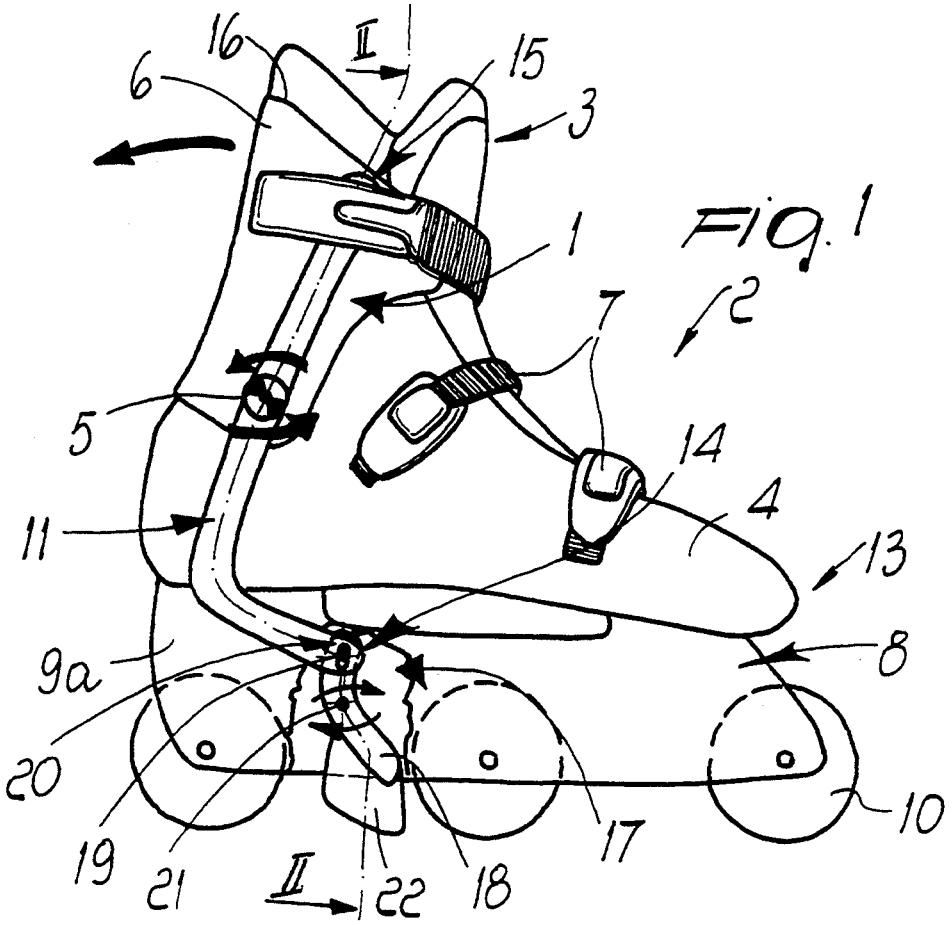
FIG. 1 is a side view of a skate according to a first aspect of the invention.
Figure 2:
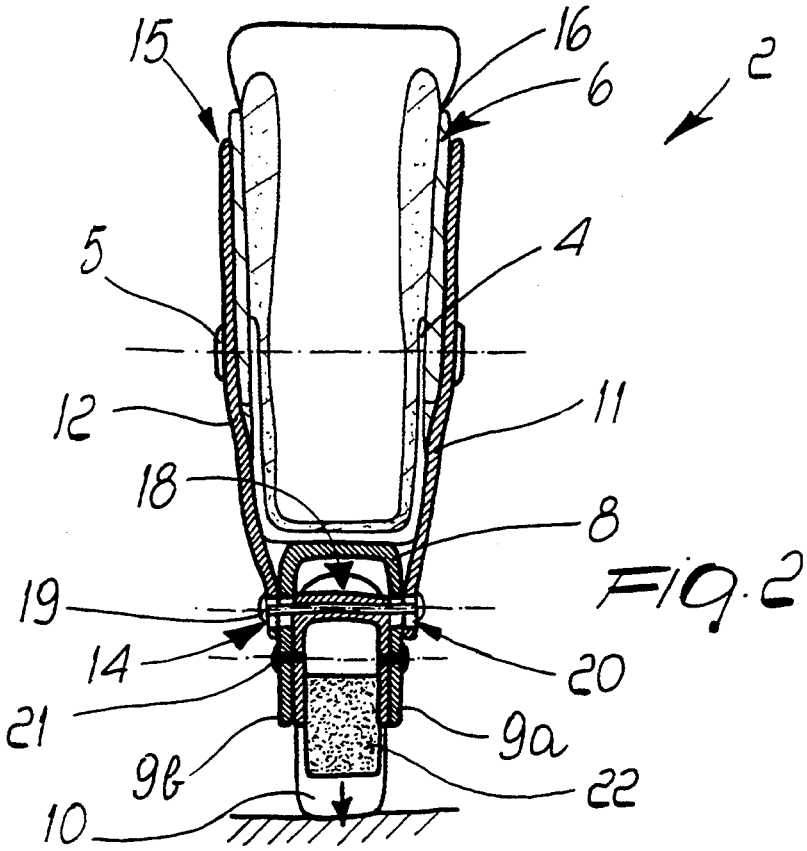
FIG. 2 is a rear cross section view according to the plane II—II of FIG. 1.

With reference to FIGS. 1-2, the reference numeral 1 designates a braking device, particularly usable if associated with skates, designated by the reference numeral 2, of the type comprising an item of footgear 3 composed of a shell 4 to which a quarter 6 is laterally articulated by means of a pair of studs 5, said quarter embracing the leg of the user laterally and to the rear.

The shell 4 and the quarter 6 have flaps which can be secured by using adapted known levers 7.

A frame 8 is associated with the shell 4 and has a pair of lateral wings 9*a* and 9*b* between which one or more wheels 10 are pivoted; in the particular embodiment, said wheels are mutually aligned.

The braking device comprises, in the illustrated embodiment, a first rod member 11 and a second rod member 12 which are arranged laterally with respect to the quarter 6, to the shell 4 and to the frame 8.

The first and second rod members thus have a curved shape approximately complementary to the lateral regions of the quarter and of the shell, whereas at the region of the frame 8 the rod members are curved toward the toe 13 of the item of footgear 3 so as to arrange the end 14 in an intermediate region between two adjacent wheels.

The other end 15 of the first and second rod members adjacent to the upper perimetric edge 16 of the quarter 6, is rigidly coupled to said quarter, for example by means of adapted screws, whereas the rod members are rotatably associated at the pair of studs 5 for pivoting the quarter 6 to the shell 4.

As an alternative, the first and second rod members may be rotatably associated at other studs which are laterally rigidly coupled to the shell 4.

Thus, a backward rotation of the quarter 6 is matched by a movement of the end 14 of the first rod member 11 and of the second rod member 12 toward the toe 13 of the item of footgear.

A first braking element 17 is also associated with the end 14 of the first and second rod members, constituted by a C-shaped support 18 with its wings directed toward the ground. The support is rotatably associated at its base transversely and internally with respect to the frame 8 by means of a first pivot 19 which passes through adapted slots 20 formed on the ends 14 of the first and second rod members.

The slots 20 allow to move the pivot 19 approximately along an axis which is parallel to the ground as a consequence of the movement of the ends 14 toward the toe 13 of the shell, which is a consequence of the backward rotation of the quarter 6.

The support 18 is also pivoted, at its wings, transversely to the lateral wings 9*a* and 9*b* of the frame 8 by means of a second pivot 21 which is arranged transversely between said wings.

An element 22, such as a rubber pad suitable to interact with the ground to brake the skate, is associated between the ends of the wings of the support 18 which are adjacent to the ground.

Figure 3:
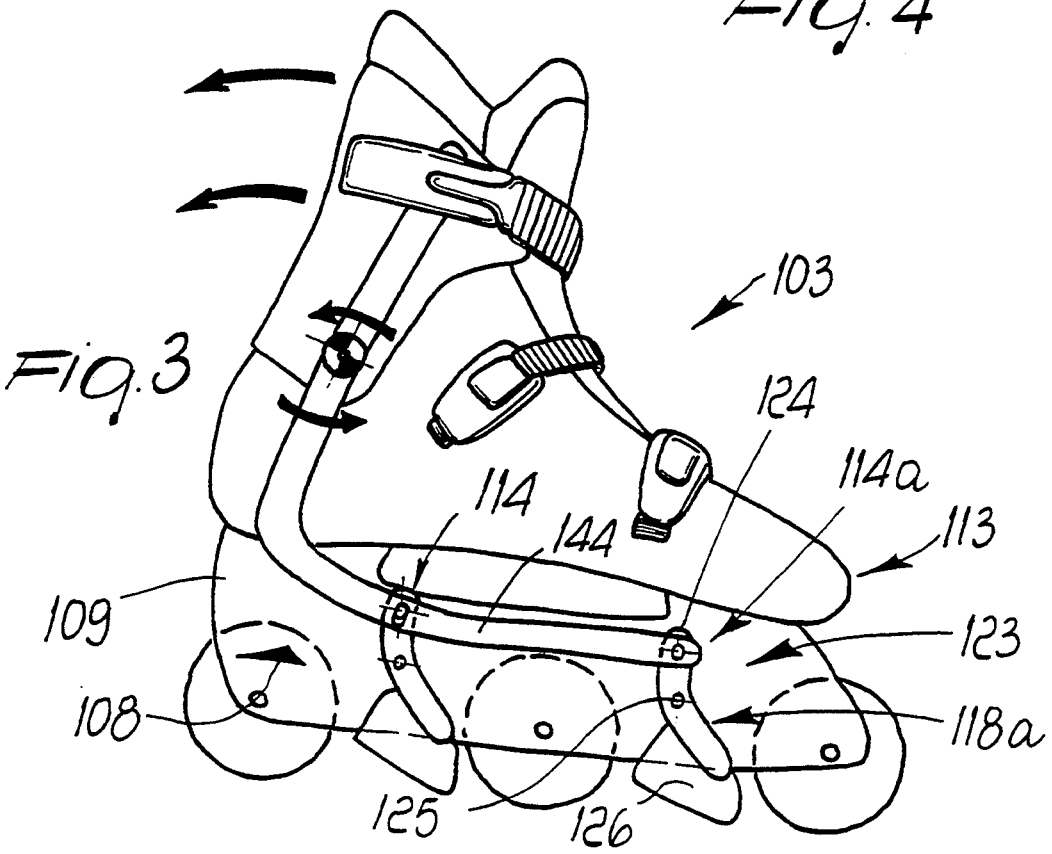
FIG. 3 is a side view of a skate according to a second aspect of the invention.
Figure 5:
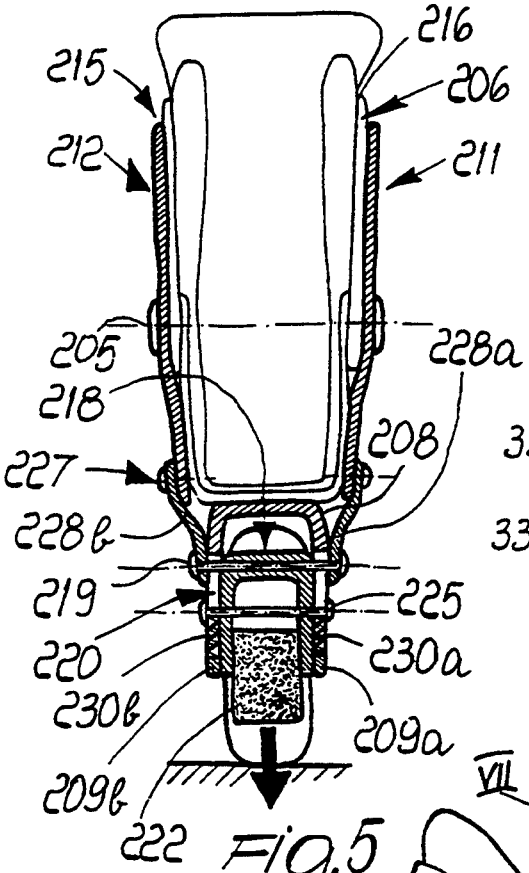
FIG. 5 is a rear cross section view according plane V—V of FIG. 4.

In order to improve the braking action it is possible to provide a plurality of braking elements so that, as shown in FIG. 3, an extension 144 can be associated with the ends 114, extending toward the toe of said item of footgear; one or more braking elements are associated with the extension 144.

It is thus possible to arrange, adjacent to the toe 113 of the item of footgear 103, a second braking element 123 again constituted by a support 118*a* which is articulated, at its base, to the end 114*a* of the first and second rod members by means of a third pivot 124. The support is in turn pivoted between the lateral wings 109 of the frame 108 by means of a fourth pivot 125, whereas a second element 126, such as an additional rubber pad, is associated with the end of the support which is directed toward the ground.

The use of the present invention is very simple: every time the user rotates the quarter backwards, the ends 14 of the first and second rod members consequently rotate towards the toe of the item of footgear. In this manner, a rotation is imparted to the support of the first braking element and of any second braking element, so as to move the first element 22 and/or the second element 126 into contact with the ground.

Depending on the degree of tilt imparted to the quarter, the elements 22 and/or 126 press more or less intensely against the ground so as to vary the degree of braking imparted to the item of footgear.

It has thus been observed that the present invention has solved the described technical problems, achieving the intended aim and objects, a skate having in fact been obtained wherein it is possible to brake very rapidly and easily and a braking device having been obtained which is very simple and easy to industrialize.

Furthermore, the braking action cannot be accidental, because during skating the user usually assumes a position in which his weight is directed forward, thus imparting a given forward inclination to the quarter, thus ensuring the lifting of the first braking element and of any second braking element from the ground.

Therefore, only if the user rises from this position, the required degree of rotation can be imparted to the quarter and the braking action can thus be achieved.

The skate according to the invention is naturally susceptible to numerous modifications and variations, all of which are within the scope of the same inventive concept.

Figure 4:
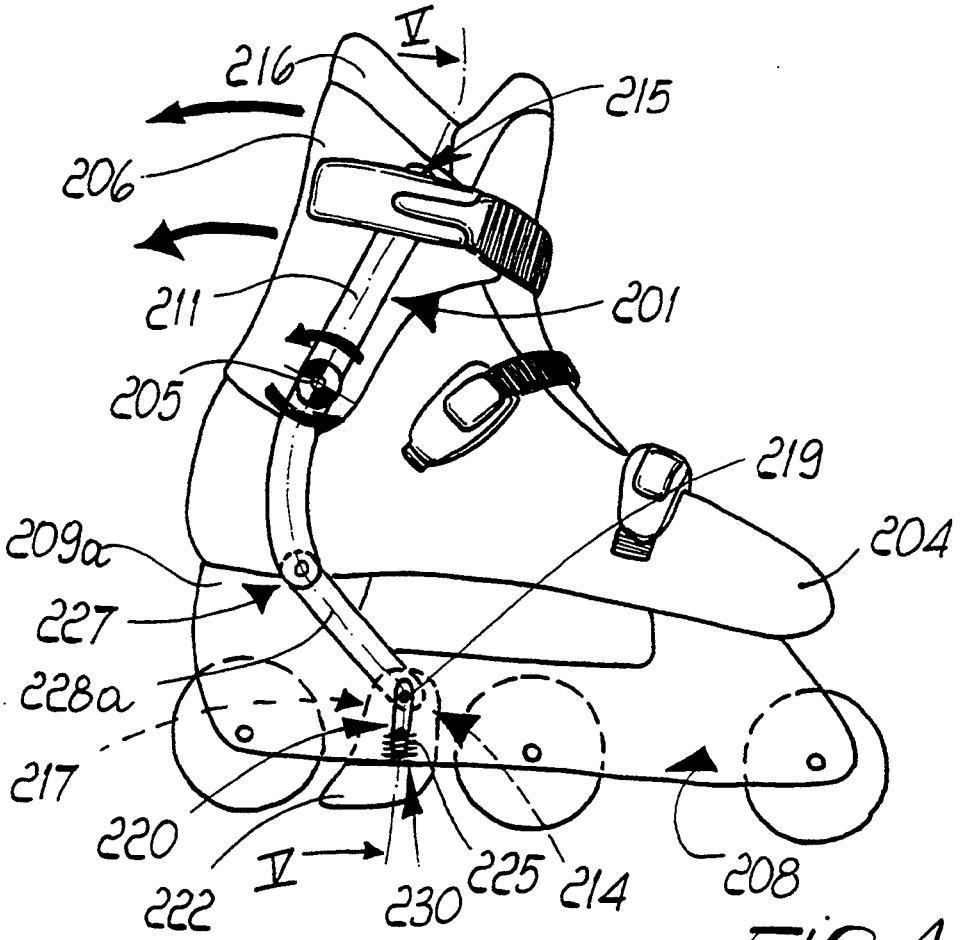
FIG. 4 is a side view of a skate according to a third aspect of the invention.

FIG. 4 illustrates a further embodiment for a braking device 201 wherein the first rod member 211 and the second rod member 212 are again rigidly coupled, at the end 215 which is adjacent to the upper perimetric edge 216 of the quarter 206, laterally to said quarter and are also rotatably associated with said quarter at the studs 205 for articulation to the shell 204.

In the region of the first rod member 211 and of the second rod member 212 which is adjacent to the frame 208 there is an articulation 227 which is obtained for example by means of the free articulation of an end of a pair of rods 228*a* and 228*b* at the other end of which a braking element 217 is associated.

The braking element comprises a support 218 which is transversely pivoted, at its base, inside the frame 208 by means of a first pivot 219.

The support is C-shaped with its wings directed toward the ground, whereas the first pivot 219 passes through adapted slots 220 formed on the lateral wings 209*a* and 209*b* of the frame 208.

An element 222 is arranged between the wings of the support 218 and is constituted by a rubber pad which interacts directly with the ground upon a backward rotation imparted to the quarter 206.

The wings of the support 218 are pivoted transversely to the lateral wings 209*a* and 209*b* of the frame 208 by means of a fourth pivot 225 which affects the slots 220.

An element 222, such as a rubber pad, is associated with the ends of the wings of the support which are directed toward the ground.

The fourth pivot 225 is slideable within the slots 220 in contrast with an elastically deformable element such as a spring 230*a* and 230*b*.

A backward rotation of the quarter 206 produces the rotation of the first and second rod members and, by virtue of the presence of the articulation 227, the first pivot 219 slides within the slots 220*a* and 220*b*, pushing the support and thus the pad toward the ground; impact with the ground is adjusted by the presence of the elastically deformable element 230.

Figure 7:
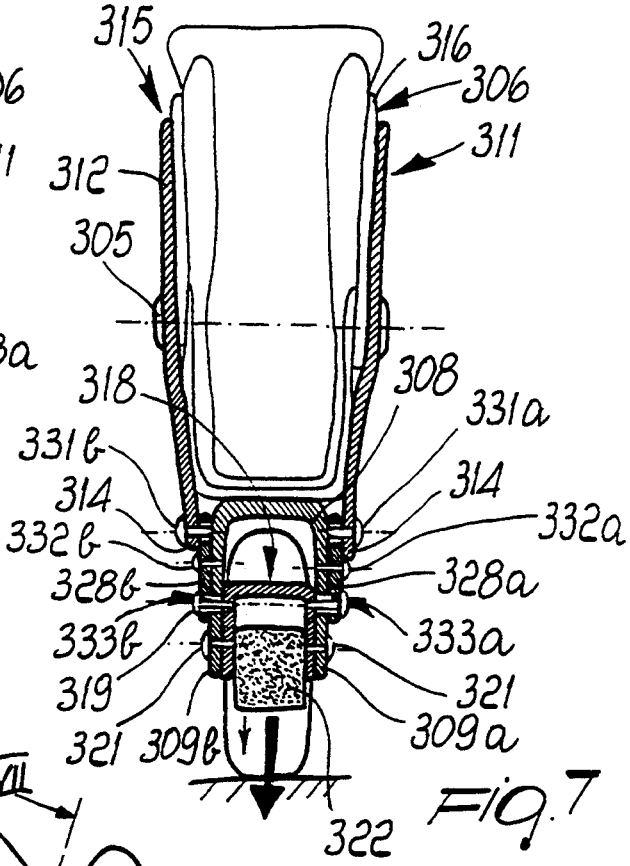
FIG. 7 is a rear cross section view according to the plane VII—VII of FIG. 6.
Figure 6:
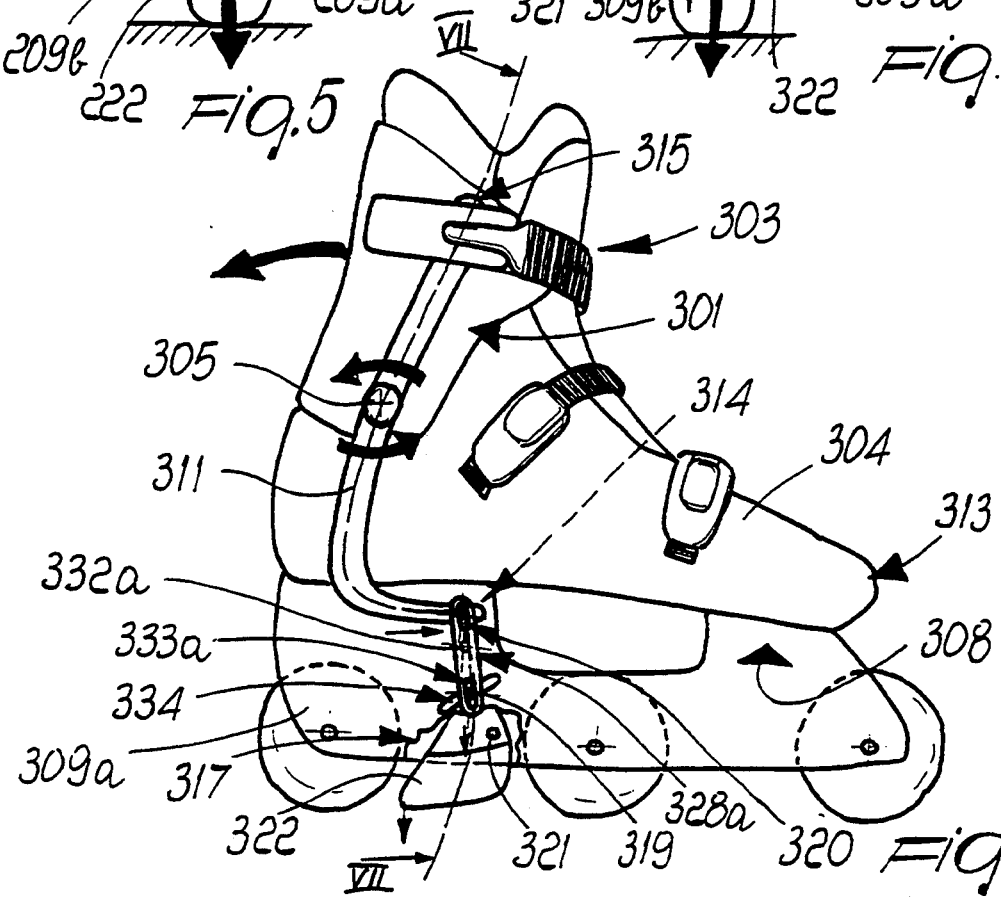
FIG. 6 is a side view of a skate according to a fourth aspect of the invention.

FIGS. 6 and 7 illustrate a further embodiment for a braking device 301 in which the first rod member 311 and the second rod member 312 are again rigidly coupled, at the end 315 which is adjacent to the upper perimetric edge 316 of the quarter 306, laterally to said quarter and are furthermore rotatably associated with said quarter at the studs 305 for articulation to the shell 304.

The first and second rod members have a curved shade which is approximately complementary to the lateral regions of the quarter and of the shell, while at the region of the frame 308 said rod members are curved toward the toe 313 of the item of footgear 303 so as to arrange the end 314 in an intermediate region between two adjacent wheels.

A fifth pivot 331*a* and 331*b* is associated with the ends 314 of the first and second rod members and is located at a first slot 320 which is formed at an end of a pair of rods 328*a* and 328*b* at the other end whereof a braking element 317 is associated.

In an intermediate region, said rods 328*a* and 328*b* are pivoted to the wings of the frame 308 by means of sixth pivots 332*a* and 332*b*.

Second slots 333*a* and 333*b* are formed at the ends of the rods 328*a* and 328*b* which are adjacent to the ground and act as seats for the first pivot 319 for connecting the braking element 317 and said rods to the wings of the frame 308; third slots 334 are formed on said wings and have a given inclination with respect to the longitudinal axis of said frame, such as to allow rotation of the rods following a backward rotation of the quarter.

The braking element 317 is constituted by a C-shaped support 318 in which the wings are directed toward the ground; at its wings, the support is rotatably associated transversely and internally with respect to the frame 308 by means of the first pivot 319.

The support 318 is furthermore pivoted, at its wings, transversely to the lateral wings 309*a* and 309*b* of the frame 308 by means of a second pivot 321 which is arranged transversely between said wings.

An element 322, such as a rubber pad, suitable to interact with the ground to brake the skate, is associated between the ends of the wings of the support 318 which are adjacent to the ground.

In this embodiment, the pad is not subject to jamming during the braking action.

Figure 9:
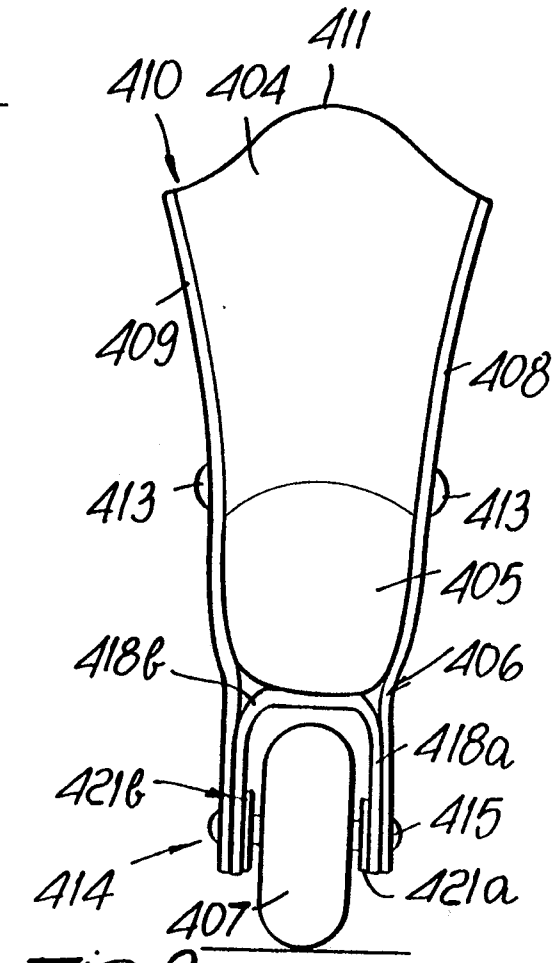
FIG. 9 is a rear view of the skate of FIG. 8.
Figure 10:
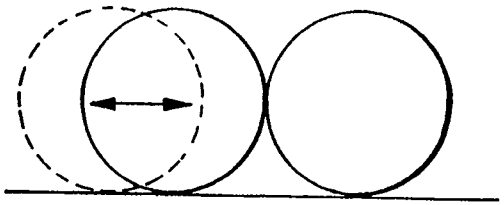
FIG. 10 shows schematically the motion of the wheels of the skate of FIG. 8.
Figure 8:
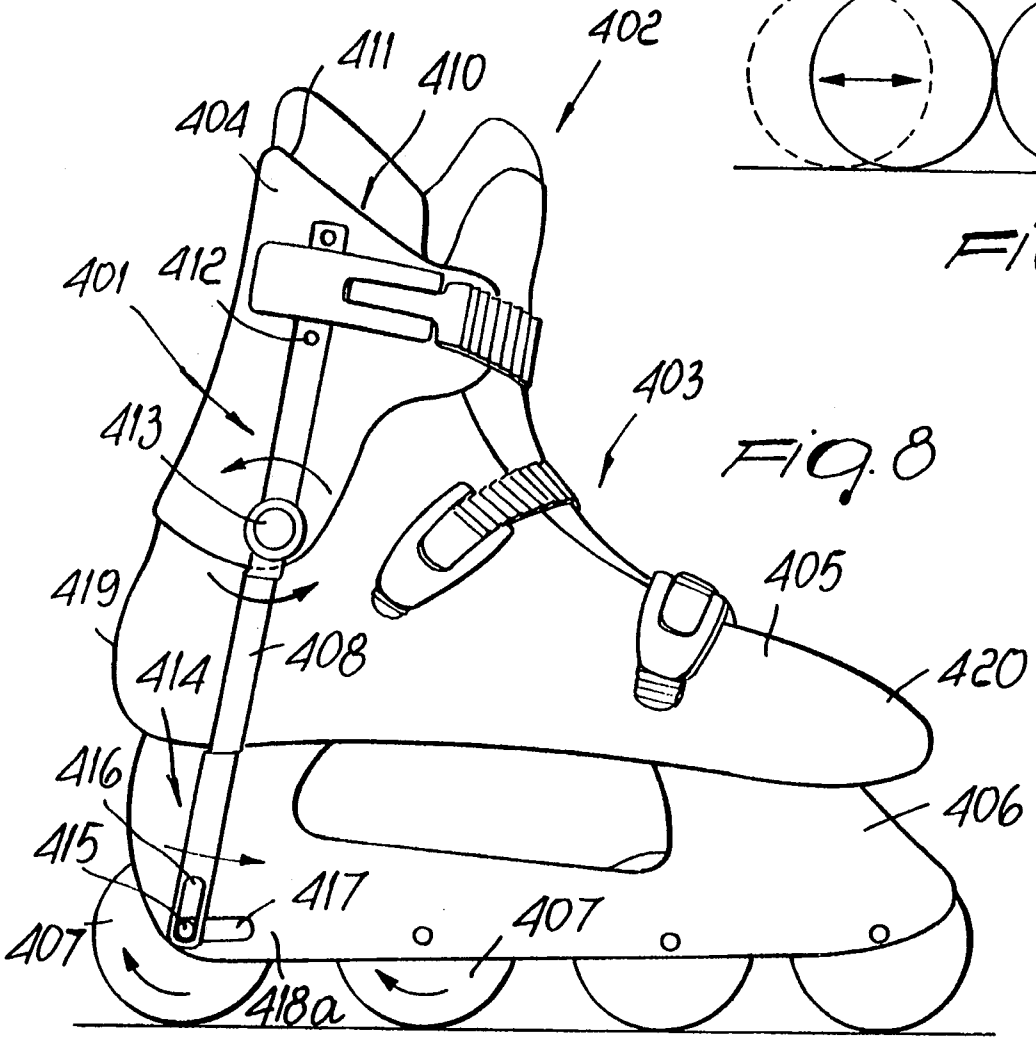
FIG. 8 is a side view of a skate according to a fifth aspect of the invention.

With reference to FIGS. 8–10, the numeral 401 designates the braking device, which is particularly usable for skates, designated by the reference numeral 402, which comprise an item of footgear 403 composed of a quarter 404 which embraces the user's leg to the side and rear and is in turn articulated to a shell 405.

A supporting frame 406 for a plurality of mutually aligned wheels 407 is associated below said shell.

The structure comprises one or more rod members which, in the particular embodiment, are constituted by a first rod member 408 and by a second rod member 409 which are arranged laterally to the quarter 404, to the shell 405 and to the frame 406.

The first and second rod members have a curved shape to match approximately the shape of the lateral regions of the quarter, shell and frame.

Each one of the first and second rod members is associated, at a first end 410 which is adjacent to the upper perimetric edge 411 of the quarter 404, with said quarter 404 by means of screws or rivets 412.

Each one of the first and second rod members is thus associated with the quarter and/or shell so as to be able to rotate. In the particular embodiment shown, the first and second rod members are associated so as to be able to rotate at the stud 413 for the pivoting of the quarter 404 with the shell 402; this means that a rotation imparted by the quarter 404 is followed by a movement of the second end 414 of each one of said first and second rod members which is adjacent to the frame 406.

Means for connecting to the pivot 415 of an adjacent wheel 407 are provided at said second end; said means are constituted by a first slot 416 which is formed longitudinally at both of the second ends 414 of the first and second rod members 408 and 409.

The end of the pivot 415 is associated at the first slot 416.

The end 416 can also slide with respect to the frame 406 toward the adjacent wheel 407. This sliding is allowed by the presence of a second slot 417 which is defined at both wings 418*a* and 418*b* of the frame 406 which embrace the aligned wheels.

The second slot 417 is formed longitudinally with respect to the frame and allows, upon a backward rotation imparted to the quarter 404, the wheel 407 to move toward the adjacent wheel arranged in front of it.

Advantageously, it is possible to provide means for guiding the pivot 415 with respect to the frame 406; said means can be constituted, for example, by arranged springs or elastically deformable elements which are arranged at the second slots 417 and are suitable to force the arrangement of the pivot 415 toward the heel 419 of the item of footgear 403.

Alternatively, it is possible to provide guiding means for the first and second rod members which are arranged at the quarter 404, the shell 402 or the frame 406. Said means can be constituted, for example, by adapted curved guides which are formed thereon and interact with adapted lugs which protrude from the first and second rod members.

Advantageously, there is also a pair of washers 421*a* and 421*b* which are arranged coaxially to the pivot 415 and are interposed between the wings 418*a* and 418*b* of the frame 406 and the wheel; their function is to keep said wheel guided on the vertical plane so as to avoid rotations of the wheel on the vertical axis.

The use of the skate is thus as follows: once a backward rotation of the quarter 404 has been imparted, the second ends 414 of the first and second rod members 408 and 409 are moved toward the tip 420 of the item of footgear 403 by such an extent that the wheel whose pivot 415 is arranged at the first slot 416 and at the second slot 417 moves adjacent to, and interacts with, the wheel arranged in front of it, which is rigidly pivoted to the frame 406.

This interaction entails a braking action, since the two wheels which temporarily mutually interact rotate in the same direction.

Figure 11:
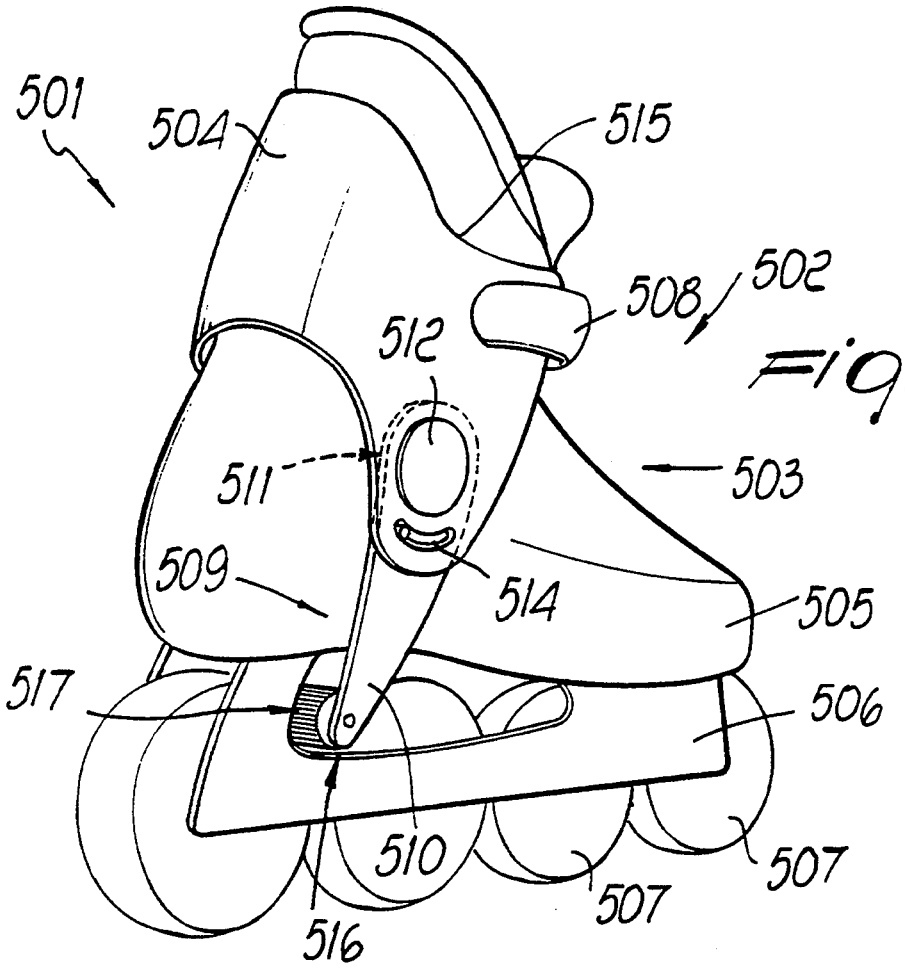
FIG. 11 is a rear perspective view of a skate according to a sixth aspect of the invention.
Figure 12:
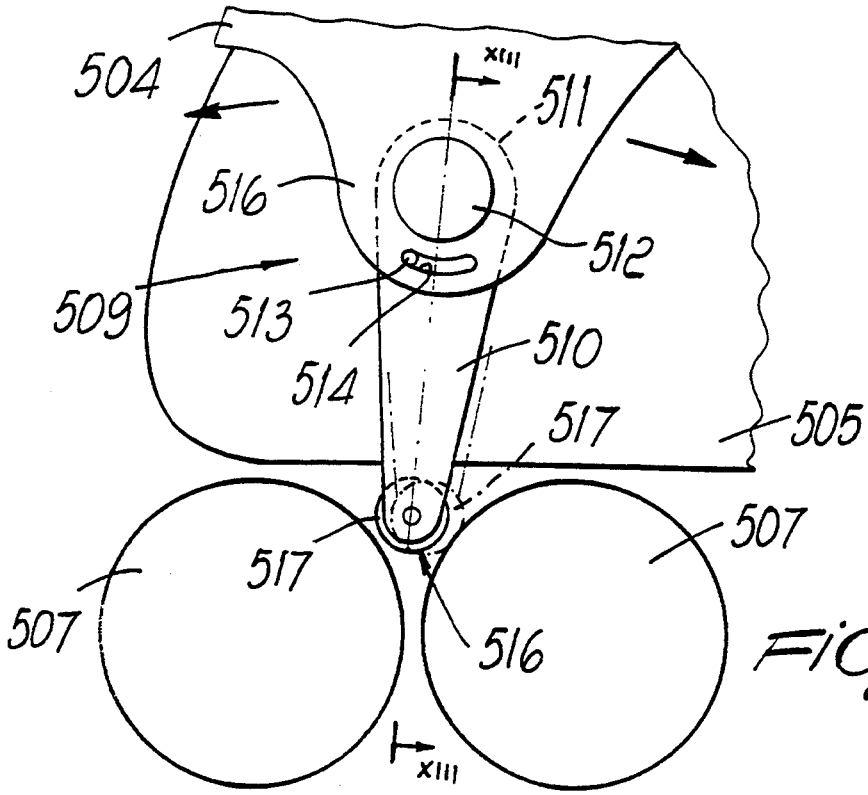
FIG. 12 is a side enlarged view of the rear portion of the skate of FIG. 11.
Figure 13:
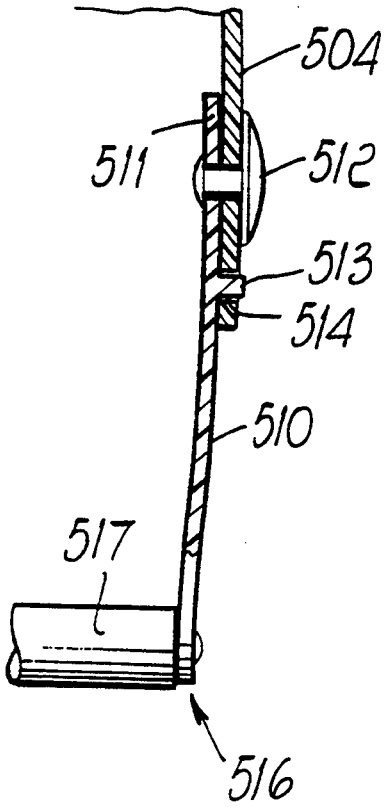
FIG. 13 is a cross section view according to the plane XI—XI of FIG. 12.

With reference to FIGS. 11–13, a skate 502 has an item of footgear 503 including a quarter 504 which embraces the rear-lateral region of the user's leg and is articulated to a shell 505, with which a supporting frame 506 for two or more wheels is associated in a downward region; said wheels are designated by the reference numeral 507 and may be mutually aligned.

The application of adapted securing levers 508 for the quarter 504 and the shell 505 is provided for.

The braking device 501 comprises a brake 509 constituted by a pair of rod members 510 each having a larger base 511 rotatably associated at the studs 512 for the pivoting of the quarter 504 with respect to the shell 505.

Advantageously, the base 511 is interposed between the external surface of the shell and the internal surface of the quarter and is free with respect to the movement of the stud 512.

Rotation of the quarter 504 rotates each pair of rod members 510, because the rod members are provided with means for connection to the quarter which are constituted by adapted pins 513 protruding from the lateral surface of the shell and arranged within an adapted guide 514 having its concave part directed towards the upper perimetric edge 515 of the quarter 504. The guide 514 is formed at a pair of tabs 516 protruding laterally and in a downward region with respect to the quarter 504 below the studs 512.

The extension of the guides 514 is such as to allow the free forward oscillation of the quarter 504 without transmitting movement to the pair of rod members 510 and such as to transmit movement to said rod members beyond a preset angle of backward rotation of the quarter 504, since the pins 513 abut, at their stroke limit, against an end of the guide 514.

The rod members in fact have, at the opposite end with respect to the bases 511, a lower end 516 arranged below the item of footgear 502 in the interspace between two mutually adjacent wheels 507.

A roller 517 is located between the ends of the tips, and its rolling surface interacts with the rolling surface of the wheel facing it and directed opposite to the heel of the item of footgear beyond a preset angle of backward rotation of the quarter.

Use of the device according to the invention is as follows: during ordinary skating, the quarter 504 can oscillate without transmitting the movement to the pair of rod members 510; accordingly, the roller 517 does not interact with the wheels and thus no braking action occurs.

Only in case of a preset backward rotation of the quarter, and thus beyond a preset angle, do the pins 513 abut against an end of the guide 514 and is movement thus transmitted to the rod members and therefore to the roller 517, which interacts with a wheel 507.

The angle of backward rotation of the quarter which allows the roller to interact with the wheel can be set by varying the length of the rod members or by changing the thickness of the pins 513.

The pins 513 may also be removable and selectively arranged within adapted and separate seats formed on the bases 511, so as to allow to change the rotation angle of the quarter which is necessary to move them into abutment against one end of the guide 514.

Figure 14:
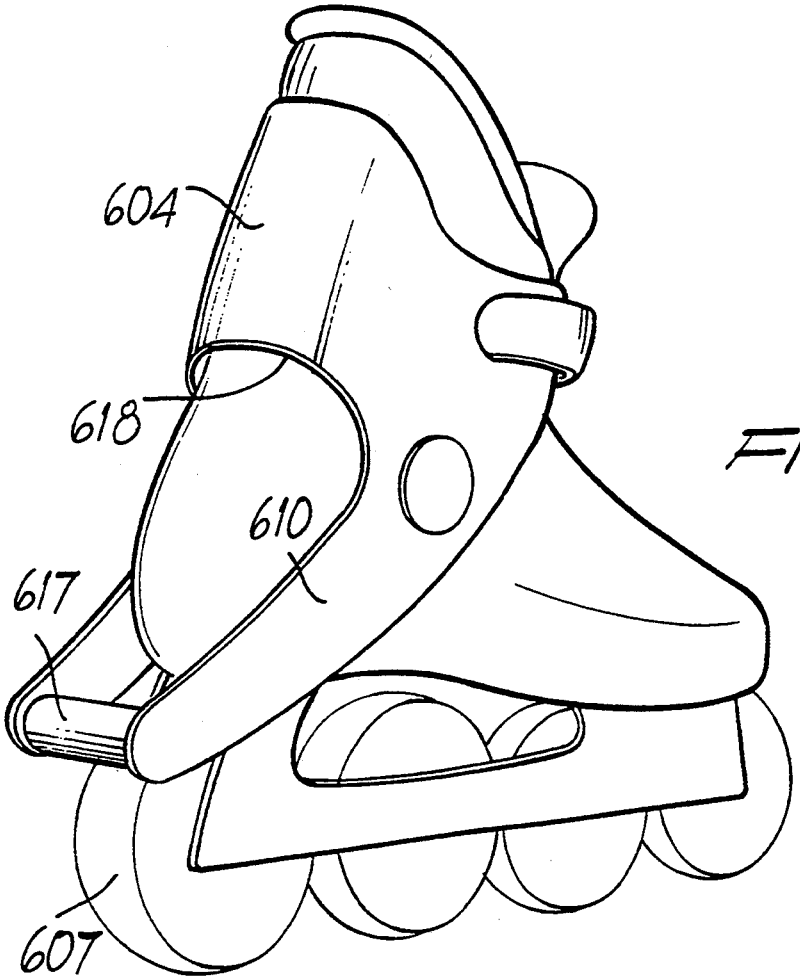
FIG. 14 is a rear perspective view of a skate according to a seventh aspect of the invention.

FIG. 14 shows a further embodiment of the invention wherein rod members 610 may have an end rigidly coupled laterally to the quarter 604, for example by providing the rod members during the molding of said quarter. The rod members thus protrude laterally and below said quarter at the lower perimetric edge 618.

In this solution, the configuration and the dimensions of the rod members define, together with the diameter of the roller 617, the rotation angle of the quarter which makes said roller interact with one of the wheels 607, which in this case is preferably the rear wheel.

Figure 15:
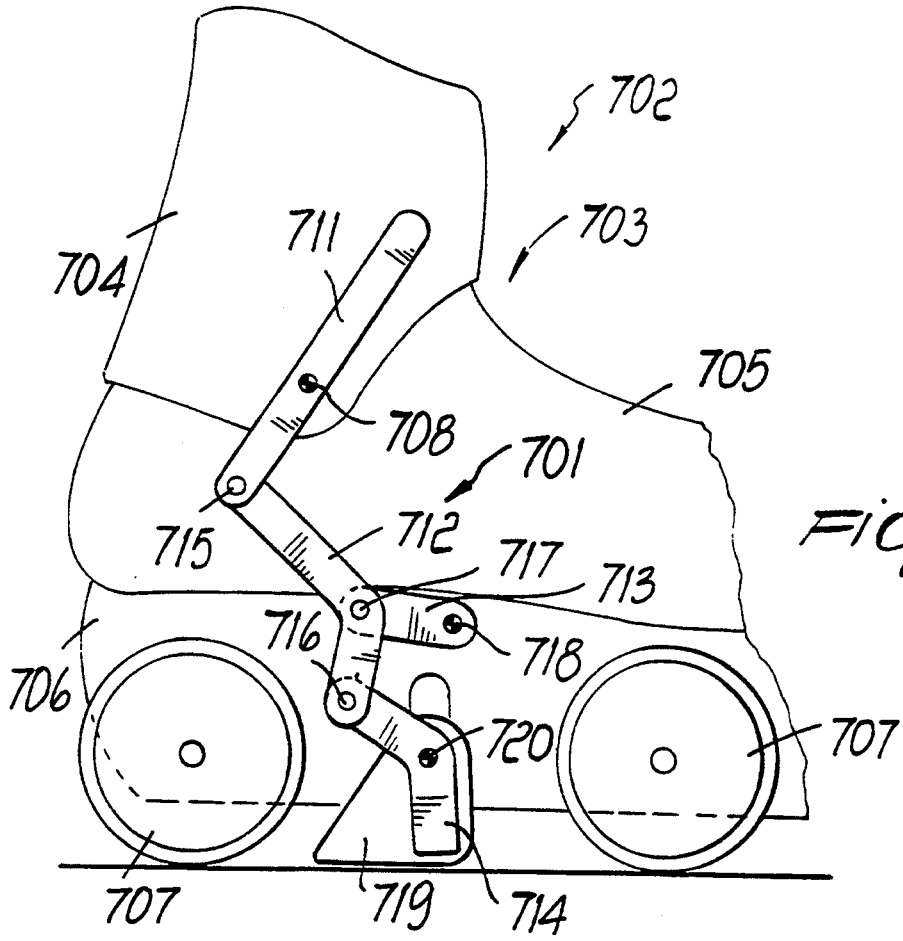
FIG. 15 is a side partial view of a skate according to an eighth aspect of the invention, showing the brake in the idle position.
Figure 16:
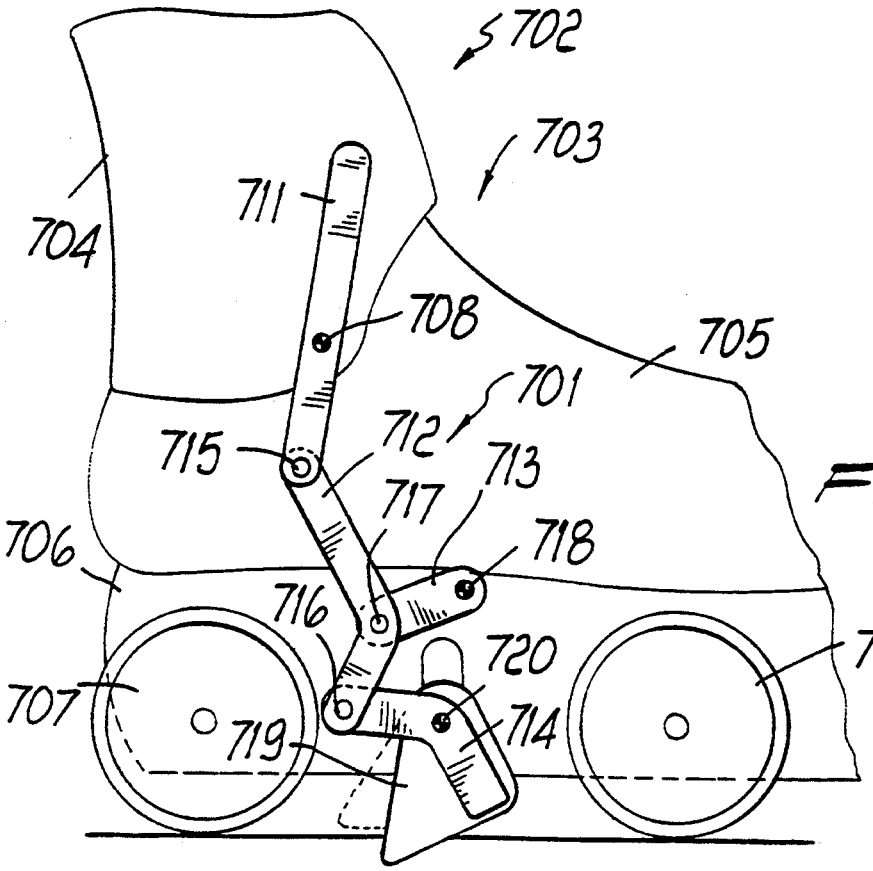
FIG. 16 is a view similar to the preceding one showing the brake in the braking position.

FIGS. 15–16 illustrate a further embodiment of the invention wherein a skate 702 comprises a shoe 703 composed of a quarter 704 articulated to a shell 705 at a pivot 708. The shell 705 is associated with a supporting frame 706 having a set of aligned wheels 707.

The braking device 701 comprises a first rod 711 rigidly associated with the quarter 704, a second rod 712, a third rod 713 and a fourth rod 714.

The second rod 712 is L-shaped and has a first end, articulated to the first rod 711 at a pivot 715, and a second end articulated at the fourth rod 714 at a pivot 716.

At the corner, the L-shaped rod 712 has pivot 717 for the articulation to one end of the third rod 713. The other end of rod 713 is articulated to a pivot 718 which is rigidly associated with the frame 706.

A pad, or block, 719 is rigidly associated to the fourth rod 714 which is also L-shaped and has a pivot 720 rigidly associated with the frame 706.

The operation of the braking device is apparent from the description and from the figures. A backward rotation of the quarter 704 causes the fourth rod 714, and therefore the pad 714, to rotate about the pivot 720, as illustrated in FIG. 16.

The materials and the dimensions constituting the individual components of the device may be the most pertinent according to the specific requirements.

We claim:

1. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, said braking device comprising a first and a second rod members which are arranged laterally to said quarter, said shell and said frame; said rod members being shaped so as to approximately match the shape of said quarter and said shell; said first and second rod members being curved toward the toe of said item of footgear at said frame, so as to arrange their lower ends in an intermediate region between two adjacent wheels, the upper end of said first and second rod members which is adjacent to the upper perimetric end of said quarter being rigidly associated with said quarter; said first and second rod members being rotatably associated at studs for pivoting said quarter to said shell, wherein a first braking element is associated with said end of said first and second rod members; said first braking element being constituted by a C-shaped support in which the wings are directed toward the ground, and is rotatably associated at its base transversely and internally with respect to said frame by means of a first pivot which passes through adapted slots formed on said ends of said first and second rod members; said slots having such a shape as to allow the movement of said first pivot approximately along an axis which is parallel to the ground following a movement of said ends toward the toe of said shell which is a consequence of a backward rotation imparted to said quarter; said support being pivoted, at its wings, transversely to lateral wings of said frame by means of a second pivot which is arranged transversely between said wings.

2. Device according to claim 1, wherein an element, such as a rubber pad, suitable to interact with the ground to brake the skate is associated between the ends of said wings of said support which are adjacent to the ground.

3. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, said braking device comprising a first and a second rod members which are arranged laterally to said quarter, said shell and said frame; said rod members being shaped so as to approximately match the shape of said quarter and said shell; said first and second rod members being curved toward the toe of said item of footgear at said frame, so as to arrange their lower ends in an intermediate region between two adjacent wheels, wherein an extension is associated with said ends and extends toward the toe of said item of footgear; a braking element being associated with said extension and being constituted by a support articulated, at its base, to said extension by means of a third pivot; said support being pivoted between lateral wings of said frame by means of a fourth pivot, whereas a second element, such as an additional rubber pad, is associated with the end of said support directed toward the ground.

4. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, said braking device comprising a first and a second rod members which are arranged laterally to said quarter, said shell and said frame; said rod members being shaped so as to approximately match the shape of said quarter and said shell; said first and second rod members being curved toward the toe of said item of footgear at said frame, so as to arrange their lower ends in an intermediate region between two adjacent wheels, wherein an articulation is provided in the region of said first and second rod members which is adjacent to said frame, comprising a rod; said braking element being constituted by a support which is pivoted transversely, at its base, inside said frame by means of said first pivot, said support being C-shaped with its wings directed toward the ground and said first pivot passes through adapted slots formed on said lateral wings of said frame; an element constituted by a rubber pad being arranged between said wings of said support and directly interacts with the ground upon a backward rotation imparted to said quarter, said wings of said support being pivoted transversely to said lateral wings of said frame by means of a fourth pivot affecting said slots, said fourth pivot being slideable within said slots in contrast with an elastically deformable elements a fifth pivot being associated with the ends of said first and second rod members and is located at a first slot formed at one end of a pair of rods at the other end of which a braking element is associated, second slots being formed at said ends of said pair of rods which are adjacent to the ground and act as seats for said first pivot for connecting said braking element and said pair of rods to said wings of said frame, third slots being provided on said wings, said slots having such an inclination with respect to the longitudinal axis of said frame to allow the rotation of said rods following a backward rotation of said quarter.

5. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, wherein said at least one rod member has, at a lower end thereof, means for connection to the pivot of one of said wheels capable of sliding with respect to said frame in the direction of an adjacent wheel, and wherein said rod member is associated, so as to be able to rotate freely, at the stud for the pivoting of said quarter of said shell, said rod member having a second end, adjacent to said frame, on which means for connection to a pivot of one of said wheels are defined, said means being constituted by a first slot which is formed longitudinally to said rod members within which an end of said pivot can slide, said end of said pivot being slideable with respect to said frame in the direction of an adjacent wheel by virtue of a second slot which is formed approximately longitudinally with respect to the wings of said frame which embrace said wheels.

6. Device according to claim 5, wherein it comprises a pair of washers which are arranged coaxially to said pivot and are interposed between said wings of said frame and said wheel.

7. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, wherein said at least one rod member has an upper end articulated to a stud of said quarter, a lower end arranged at said wheels, said lower end being connected to said braking element arranged between adjacent wheels, said quarter having a slot, said rod member being arranged between said quarter and said shell, said rod member having a pin, said pin being adapted to slide in said slot upon a forward rotation of said quarter, said pin being engaged by said slot upon a backward rotation of said quarter causing said braking element to interact with at least one of said wheels.

8. Braking device, particularly for skates which comprise an item of footgear composed of a quarter articulated to a shell associated with a supporting frame having a set of wheels, at least one rod member being associated with said quarter, at least one braking element being associated with said at least one rod member, said braking element being adapted to interact with either one of said wheels and said ground upon a rotation of said quarter, wherein the braking device comprises a first rod member, a second rod member, a third rod member and a fourth rod member, said second and fourth rod members being L-shaped and each having a corner, said first rod member being rigidly associated with said quarter, said second rod member having a first end articulated to said first rod member at a first pivot, said second rod member having its corner articulated to said third rod member at a second pivot, said third rod member having a first end articulated to said second pivot and a second end articulated to a third pivot, said third pivot being rigidly associated with said frame, said second rod member having a second end articulated to a first end of said fourth rod member at a fourth pivot, said fourth rod member having its corner articulated to a fifth pivot rigidly associated to said frame, said fourth rod member being rigidly associated to a braking element adapted to interact with the ground upon a backward rotation of said quarter.

9. A braking device in a skate, the skate comprising:

a shell for supporting a user's foot portion;

a quarter arranged above said shell for supporting a user's ankle region;

means for articulating said quarter upwardly to said shell thereby said quarter being pivotable substantially rearwardly and forwardly about a transverse axis with respect to said shell;

a plurality of wheels; and supporting means connected below said shell for rotatably supporting said plurality of wheels, said braking device comprising:

at least one rod member;

means for connecting said rod member to said quarter thereby said rod member having an upper portion connected to said quarter and a lower portion which extends below said quarter and adjacent said shell, said rod member being pivotable together with said quarter with respect to said shell thereby the lower portion of said rod member assuming a first forward position with respect to said shell when said quarter assumes a rearward pivoting position with respect to said shell and the lower portion of said rod member assuming a second rearward position with respect to said shell when said quarter assumes a forward pivoting position with respect to said shell;

at least one pad braking member; and means for connecting said pad braking member to said lower portion of said rod member thereby the pad braking member assumes a non-braking position upwardly with respect to said plurality of wheels when said lower portion is in said second rearward position, and said pad braking member assumes a braking position downwardly with respect to said plurality of wheels for engaging with the surface upon which said plurality of wheels is supported when said lower portion is in said first forward position.

10. The braking device of claim 9, comprising a first said at least one rod member and a second said at least one rod member arranged at mutually opposite lateral sides of said skate, said means for connecting said pad braking member connecting both lower portions of said first and second said at least one rod members to said pad braking member below said supporting means.

11. The braking device of claim 9, comprising a first pad braking member and a second pad braking member both connected to said lower portion of said at least one rod member.

* * * * *

UNITED STATES PATENT AND TRADEMARK OFFICE

CERTIFICATE OF CORRECTION

PATENT NO. : 5,374,070

DATED : December 20, 1994

INVENTOR(S) : Alfred Pellegrini Jr., Andrea Tormena, Alessandro Pozzobon, Renzo Balbinot It is certified that error appears in the above-indentified patent and that said Letters Patent is hereby corrected as shown below:

On the title page, item [75], change "Mario Conella" to --Mario Gonella--.

Signed and Sealed this

Twenty-first Day of March, 1995

*Attest:*

Bruce Lehman

BRUCE LEHMAN

*Attesting Officer*

*Commissioner of Patents and Trademarks*